US007716787B2

(12) United States Patent
Duning et al.

(10) Patent No.: US 7,716,787 B2
(45) Date of Patent: May 18, 2010

(54) LOCKING DEVICE

(75) Inventors: Ralf Duning, Solingen (DE); Gundolf Heinrichs, Remscheid (DE); Peter Hoffmann, Overath (DE)

(73) Assignee: Edscha AG, Remscheid (DE)

( * ) Notice: Subject to any disclaimer, the term of this patent is extended or adjusted under 35 U.S.C. 154(b) by 94 days.

(21) Appl. No.: 11/049,521

(22) Filed: Feb. 2, 2005

(65) Prior Publication Data

US 2006/0168757 A1 Aug. 3, 2006

(30) Foreign Application Priority Data

Jan. 20, 2005 (DE) ..... 20 2005 000 982 U

(51) Int. Cl.
*E05D 11/10* (2006.01)
*E05C 17/64* (2006.01)

(52) U.S. Cl. ..... 16/330; 16/342; 16/334; 16/386

(58) Field of Classification Search ..... 16/330, 16/334, 328, 342, 329, 331, 332, 353, 312–314, 16/299, 300, 321, 322; 296/146.11, 146.9
See application file for complete search history.

(56) References Cited

U.S. PATENT DOCUMENTS 2,712,742 A * 7/1955 Neidhart ..... 464/83
5,165,509 A * 11/1992 Kanno et al. ..... 192/44
5,276,945 A * 1/1994 Matsumura ..... 16/337
5,591,083 A * 1/1997 Kirschey ..... 464/83
5,918,347 A * 7/1999 Morawetz ..... 16/322
5,920,960 A * 7/1999 Kluting ..... 16/334
6,457,207 B1 10/2002 Horberg ..... 16/50
6,481,056 B1 * 11/2002 Jesse ..... 16/334
6,607,236 B2 * 8/2003 Mooy et al. ..... 296/146.11
2002/0069481 A1 * 6/2002 Ashline et al. ..... 16/49
2004/0261225 A1 * 12/2004 Bassi ..... 16/342

FOREIGN PATENT DOCUMENTS

DE 19626928 A1 * 2/1998
FR 2 835 276 1/2003
WO WO 9942689 A1 * 8/1999
WO WO 03 060 267 7/2003

* cited by examiner

*Primary Examiner*—Chuck Y. Mah
(74) *Attorney, Agent, or Firm*—Davidson, Davidson & Kappel, LLC

(57) ABSTRACT

A locking device for locking a first part to a second part, including a shaft which connects the first part and the second part to one another in a pivotable manner. A rotational movement of the shaft entrains the first part in rotation, and the second part is rotatably mounted on the shaft. The first part is arranged on the shaft in an axially moveable fashion and can be engaged with the second part, and at least one damping element is assigned to the shaft and to the first part.

41 Claims, 8 Drawing Sheets

LOCKING DEVICE

FIELD OF THE INVENTION

The invention relates to a locking device for locking a first part to a second part, comprising a shaft which connects the first part and the second part to one another in a pivotable manner, wherein a rotational movement of the shaft entrains the first part in rotation, and the second part is rotatably mounted on the shaft, and wherein the first part is arranged on the shaft in an axially moveable fashion and can be engaged with the second part.

BACKGROUND OF THE INVENTION

WO 03 060 267 A1 presents a locking device in which a first part can be locked to a second part. The first part is connected to a shaft, a rotational movement of the shaft causing the first part to be entrained in rotation. The second part is rotatably mounted on the shaft so that a rotational movement of the shaft rotates the first part with respect to the second part. The first part is arranged on the shaft in an axially moveable fashion, with a force accummulator acting on the first part in the direction of the second part. A damping device which has a spindle is provided between the first part and the force accumulator, said damping device bringing about a damping movement of the first part in the direction of axial engagement with the second part. A disadvantage with this type of locking device is the fact that a radial distance is formed between the first part and the shaft owing to fabrication tolerances, as a result of which it is possible for the first part to tilt with respect to the shaft, producing disruptive noise during the locking as a result of the first part striking against the shaft. In addition, a spindle-like coupling of the damping device creates severe problems when tuning the system. Noise which arises at the bushing of the first part on the shaft owing to the necessary tolerance or play is not sufficiently prevented despite the large number of components and the resulting complex assembly process. Moreover, when excessively high loads occur the locking device which is connected to the door hinge of a motor vehicle is damaged to the extent that the locking device secures the hinge and it is no longer possible to pivot the door.

U.S. Pat. No. 6,457,207 B1 presents a locking device in which a first part is rotated with respect to a second part by means of a rotational movement of the shaft, with the second part being rotatably mounted on the shaft. The first part is provided on the shaft in an axially moveable fashion, with the first part and the second part being capable of being engaged with one another.

FR 2 835 276 A1 presents a locking device for locking a first part to a second part, with the first part being pivoted with respect to the second part by means of a rotational movement of a shaft, with the second part being rotatably mounted on the shaft. The first part is provided on the shaft in an axially moveable fashion, with a spring element acting on the first part in the direction of the second part and being capable of being engaged with the second part.

The object of the invention is to specify a locking device which permits the first part to be locked securely to the second part while generating little noise.

SUMMARY OF THE INVENTION

This object is achieved by a locking device wherein at least one damping element which is assigned to the shaft and to the first part is provided. The provision of a damping element according to the invention, which is assigned to the shaft on the one hand and to the first part on the other, compensates tolerances in the axial guidance for the first part in relation to the shaft which occur as a result of fabrication and are inevitably necessary owing to the radial mobility.

While the first part is guided on the shaft with radial play, the damping elements are secured against the first part and against the shaft in a pressing fashion and compensate the radial play as a result of the elasticity inherent in them. As a result, the impact noises are avoided or at least damped without the axial mobility of the first part in relation to the shaft being blocked.

As a result of the radially secured position of the first part on the shaft, the shaft is prevented from tilting in the first part so that it is not possible for the first part and the shaft to strike against one another and the disruptive generation of noise when the two parts are locked is avoided.

Furthermore, by avoiding the tilting of the first part with respect to the shaft, the first part is secured radially in relation to the second part during the movement in the axial orientation of said first part so that the first part can be engaged uniformly with the second part in terms of area so that secure and reliable locking of the two parts to one another is brought about.

In one advantageous embodiment, the at least one damping element is arranged between the first part and the shaft, as a result of which the first part is fixed further radially in its position with respect to the shaft so that tilting as a result of the axial movement of the first part with respect to the shaft is avoided.

At least two damping elements are advantageously provided, with the two damping elements being expediently arranged diametrically on the shaft and the first part so that the shaft is damped further with respect to the first part, and the generation of noise is thus reduced further.

The first part expediently comprises a sleeve section, with the sleeve section surrounding the shaft at the circumference, as a result of which the first part is securely arranged on the shaft. The at least one damping element is assigned here to an inner side of the sleeve section so that the damping element is securely assigned both to the shaft and to the first part during the axial movement, permitting a further reduction in noise.

The first part advantageously has a groove in which the damping element is at least partially arranged, as a result of which the damping element is firmly secured to the first part, with the damping element being secured, for example, to either the first part or the shaft, during the axial movement of the first part with respect to the shaft, and being moved in relation to at least the other of the first part and the shaft, insofar as the elasticity of the damping element does not compensate the travel. It is also possible for the damping element to be moved in relation to the first part and the shaft during the axial movement.

The groove is expediently embodied in an axial manner, as a result of which the damping element, which is arranged in the groove and thus also has an axial extent, permits damping during the axial movement of the first part with respect to the shaft.

The shaft advantageously also has a groove in which the damping element is also at least partially arranged. The groove in the shaft is expediently embodied in an axial manner. The damping element is advantageously arranged both in the groove on the shaft and in the groove on the first part so that the damping element is fixed radially by the two grooves. As a result of the damping element being fixed radially, the damping of noise by the damping elements is ensured further when the first part moves with respect to the shaft.

In a further preferred embodiment, the first part and the shaft are connected to one another using positively locking means, as a result of which the rotational movement of the shaft is advantageously transmitted to the first part so that the first part is reliably entrained in rotation by the rotational movement of the shaft and is thus reliably rotated with respect to the first part. As a result of the rotation of the second part with respect to the second part, the engagement of the two parts with one another in preferred locking positions is ensured further, thus safeguarding further the locking of the first part to the second part.

The positively locking means advantageously comprise at least one engagement part and at least one receiving part, the engagement part engaging in the receiving part, as a result of which the positively locking connection of the first part to the shaft is brought about. The at least one engagement part is provided either on the shaft or the first part, the receiving part being correspondingly provided on the other of the two components, providing a flexible configuration of the positively locking means for the shaft and for the first part.

The transmission of the rotational movement of the shaft to the first part by the positively locking means is ensured further by the provision of two engagement parts and two receiving parts, one of the two engagement parts being respectively assigned to one of the two receiving parts in each case, as a result of which the forces necessary to transmit the rotational movement are advantageously distributed to the shaft and to the first part. The two receiving parts and the two engagement parts are expediently provided diametrically on the shaft and on the first part, respectively.

As a result of the fabrication tolerances which occur inevitably in the region of the engagement parts and the receiving parts as a result of the mobility of the first part with respect to the shaft, minimum radial distances between the engagement and receiving parts are possible so that the positively locking means have radial play between the shaft and the first part. The provision of the at least one damping element compensates this radial play in the positively locking means, i.e. between the engagement parts and the receiving parts, with the damping elements being advantageously provided outside the positively locking means. As a result, the shaft is fixed radially in the first part so that the play in the positively locking means is compensated and the shaft is reliably radially secured in the first part.

Two engagement parts are preferably provided with two corresponding receiving parts, the two engagement parts being provided diametrically with respect to the shaft and two damping elements which are likewise arranged diametrically with respect to one another on the shaft. The damping elements and the engagement parts are each at an angle of approximately 90° with respect to one another so that the positively locking means and damping elements are distributed uniformly on the shaft. As a result, the loading which occurs as a result of the rotation and the axial movement of the first part is advantageously reduced both by the shaft and by the first part.

It has to be understood that the at least one damping element can also be provided in the region of the positively locking means, such as, for example, on either the engagement part or the receiving part so that the play between the engagement part and the receiving part is avoided.

In order to ensure further the axial mobility of the first part with respect to the shaft, a canal is advantageously provided in the at least one engagement part or in the at least one receiving part, the canal being embodied as a reservoir for an oil or similar lubricant so that friction occurring during the movement of the first part with respect to the shaft is advantageously reduced.

The canal is expediently formed axially on the engagement part and the receiving part so that lubrication by means of the lubricant occurs during the entire axial movement of the first part with respect to the shaft. The lubricant also further advantageously reduces the generation of noise which occurs as a result of the axial movement.

The canal is expediently constructed with a semicircular cross section as a result of which the lubricant is distributed uniformly in the canal and uniform lubrication occurs, the straight section of the semicircle facing the other of the engagement part and the receiving part on which the canal is not arranged, with the result that a large area between the engagement part and the receiving part is taken up by the lubricant.

The damping element is advantageously of elastic design as a result of which the compensation of tolerances between the shaft and the first part is ensured further so that the first part always has the same orientation with respect to the second part, i.e. in particular the first part and the second part are oriented with respect to one another in such a way that the first part can reliably be firmly engaged with the second part and the two parts can be firmly locked to one another.

It is also possible that the damping element which is assigned to the shaft and to the first part is not also moved along the shaft during the axial movement moving the first and the second part apart from one another, but instead its length is merely increased by a small amount owing to its elasticity. During the opposed axial movement which moves the first and the second parts toward one another, the damping element retracts to its original length and shape. This provides the advantage that the elastic damping element provides a securing force for locking the first part to the second part, as a result of which a spring which prestresses the first part against the second part can be provided with a relatively small spring force or the spring can be omitted.

In another preferred embodiment, the at least one damping element is constructed from a plastic, as a result of which the damping element is independently adapted to the shaft and to the first part. In addition, the construction of the damping element from plastic provides the advantage that the plastic which forms the damping element is inserted or pressed with a form fit into the installation space provided for that purpose, in particular the groove formed on the shaft and the groove formed on the first part, with the damping element having an excess dimension for the radial play between the shaft and the first part. The excess dimension of the damping element is provided in such a way that it has a corresponding excess dimension with respect to the grooves arranged on the shaft and on the first part. The damping element which is formed from plastic is adapted by corresponding heat treatment. As a result of the heat treatment, the local expansion of the damping element is reduced and it adapts itself to the play between the shaft and the first part so that the radial play and axial play between the first part and the shaft is compensated by the reduced damping element.

The heat treatment advantageously takes the form, for example, of a coating method for the locking device, in particular a cathodic immersion coating method.

A method for introducing the damping element into the locking device is thus provided by the following steps. In a first step, the first part is arranged on the shaft, with radial play being provided between the first part and the shaft owing to the axial mobility. In a second step, the damping element is arranged on the shaft and the first part with a form fit, for example by pressing into grooves provided on the shaft and on the first part, with the damping element having an excess dimension for the radial play and the grooves. In a third step, the locking device is heat treated, with the excess dimension of the damping element being reduced to a form fit between the shaft and the first part.

It has to be understood that in a first step the damping element can also be secured to either the shaft or the first part, for example in a groove, and in a second step the first part is arranged on the shaft.

The heat treatment provided in the third step is preferably provided in the form of a coating method for the locking device, in particular a cathodic immersion coating method. It has to be understood that the heat treatment can also be carried out separately from the coating process, in particular in a further step before the coating process.

The damping element is expediently constructed from polyetheretherketone which has the necessary resistance to high temperature. It has to be understood that the damping element can also be formed from a metal which has the corresponding temperature properties.

The damping element is preferably formed with a circular cross section, further ensuring that the damping element is adapted laterally with respect to the shaft and the first part. For example, adaptation to the grooves provided on the shaft and to the grooves provided on the first part is possible by means of a circular and elastic configuration of the damping element, irrespective of the geometry of the grooves, since the damping element adapts itself to any type of groove as a result of the circular and elastic configuration. Any desired groove geometry can be used for the arrangement by selecting the cross section and the degree of elasticity of the damping element.

It has to be understood that the damping element can also have any further cross-sectional shape such as, for example, a rectangular cross section, a C-shaped cross section or else an X-shaped cross section.

Configuring the cross section of the damping element differently provides different degrees of elasticity of the damping element. It is thus possible, for example, for a metallic damping element also to be of elastic design, with, for example, a C-shaped cross section, as a result of which the damping element is made resilient and correspondingly adapts to the grooves and also compensates the tolerances during the axial movement of the first part with respect to the shaft.

In one preferred embodiment, the damping element is provided in the form of a pin so that the damping element adapts itself further securely to the grooves arranged in the shaft and the first part. The pin-shaped damping element advantageously has an obliquely tapering end, as a result of which the insertion of the damping element into the two grooves between the shaft and the first part is made easier.

In order to avoid movement of the damping element during the axial movement of the first part with respect to the shaft, the damping element has contouring which increases the form fit of the damping element in the grooves. The contouring is eliminated again during the heat treatment which reduces the damping element and thus adapts to the play so that the contouring does not disrupt the axial movement of the first part with respect to the shaft.

In a further advantageous embodiment, a spring element acts on the first part in the direction of the second part, as a result of which the first part experiences a force which is directed toward the second part and which holds the first part in engagement with the second part so that the first part and the second part are securely locked to one another by means of this securing force.

The spring element is preferably embodied as a helical compression spring which is supported with a first end against the first part and with a second end, facing away from the first end, on a thrust washer forming a counterbearing, with the thrust washer being expediently connected to the shaft.

A collar on which the spring element is supported against the first part is advantageously provided on the first part. The collar is expediently of disk-shaped design and runs around the circumference of the first part, and as a result the spring element is supported uniformly on the collar so that during the rotational movement and the axial movement the first part does not tilt with respect to the shaft owing to the force acting as a result of the spring element.

The second part is preferably embodied as a disk which can be expediently engaged over a surface with the collar of the first part which is embodied in the form of a disk so that the first part and the second part have a corresponding common contact face which ensures that the first part is further secured to the second part.

It has to be understood that the collar of the first part and the configuration of the second part can also be of any further geometric shape such as, for example, oval or rectangular. It is expedient here that the configuration of the collar and the configuration of the second part are matched to one another.

In one preferred embodiment, the first part and the second part are surrounded by a cap, which, on the one hand, protects the locking device against external influences, such as, for example, dust or dirt, and, on the other hand, the enclosure of the first part and of the second part by means of the cap ensures that when overloading occurs the individual parts of the locking device remain in the cap despite the loading by the spring force, avoiding undesired distribution of the individual parts. In addition, the complete encapsulation of the locking unit which is achieved in this way makes it possible to provide a single supply of lubrication which ensures freedom from maintenance over the service life.

At least one securing element and one latching element are preferably provided, the securing element engaging in the at least one latching element. The at least one securing element is provided either on the first part or the second part, with the latching element being optionally arranged on the other of the first or second part. By providing a securing element which engages in a latching element, the first part is reliably locked to the second part so that the first part is prevented from undesirably moving apart from the second part.

In one preferred refinement, three securing elements are arranged on the collar, embodied in the form of a disk, of the first part, said securing elements each comprising a cam and in each case three latching recesses which are assigned to the cams being provided on the second part which is embodied in the form of a disk. The three securing elements are each distributed over the collar at an angle of approximately 120° with respect to one another, and the three latching recesses are correspondingly distributed on the disk-shaped second part, as a result of which the securing forces for locking the first part to the second part are uniformly distributed over the disk-shaped second part and the locking of the two parts is further ensured.

In a further preferred embodiment, the locking device is provided on a hinge, the hinge having a first hinge part which is connected to a second hinge part in a pivotable fashion by means of a hinge pin. The shaft is embodied here as a continuation of the hinge pin, as a result of which the pivoting movement of the hinge pin is transmitted to the shaft so that, as a result of the pivoting movement of the first hinge part with respect to the second hinge part, the shaft is rotated and the first part is also rotated, as a result of which the first part is pivoted with respect to the second part. As a result, the first hinge part is secured with respect to the second hinge part in preferred angular positions by means of the locking device according to the invention.

It has to be understood that the locking device according to the invention can be arranged on any type of hinges, and it is thus possible, for example, that in the case of a hinge which, for example, has two hinge pins or two hinge pin sections, a locking device according to the invention can be provided either on one of the two hinge pin sections or on both hinge pin sections.

The second part is preferably connected to that hinge part in which the hinge pin is mounted with running play, i.e. to the hinge part in which the hinge pin is rotatably mounted, for example by means of a bearing bushing. The second part is connected to the hinge part by means of connecting means, such as, for example, screws or rivets, or else welded.

It has to be understood that the second part is also constructed integrally with that hinge part, and, when the first hinge part pivots with respect to the second hinge part, the first part which is arranged on the shaft is pivoted with respect to the second part. If the second part and that hinge part are configured integrally, the latching elements or the securing elements are expediently formed on this hinge part.

When the locking device is overloaded, for example when the latching mechanism is blocked, disabling of the ability of the first part to rotate with respect to the shaft is advantageously prevented. For this purpose, the locking device according to the invention has a weak point on the first part and said weak point breaks when overloading occurs and releases the shaft and the shaft can rotate freely with respect to the first part. As a result of the weak point, the forces occurring as a result of the overloading are compensated in a controlled way by the breaking of the first part.

If the locking device is, for example, provided on a hinge of a motor vehicle, disabling of the hinge in its basic function is advantageously avoided. It continues to be possible to open and close the door of the motor vehicle without problems. As a result of the weak point, the forces occurring as a result of the overloading are compensated in a controlled manner by the breaking of the first part, thus avoiding a situation in which, for example, the hinge pin of the hinge of the door of the motor vehicle breaks and the door can thus no longer be pivoted. As a result of the breaking of the first part at the weak point, the door of the motor vehicle can continue to be pivoted.

Moreover, the releasing of the shaft in accordance with the weak point of the first part means that the locking device is not blocked by damage during overloading. In addition, the release of the shaft during heavy loading prevents a corresponding force being applied to the shaft. Thus, for example when a locking device is arranged on a hinge, the release of the shaft and of the hinge pin coupled to it means that the first part can no longer be locked to the second part but instead the two parts can pivot freely with respect to one another about the shaft. The hinge of the door of the motor vehicle, and thus the door of the motor vehicle, can thus be pivoted freely about the hinge pin owing to the locking device which no longer locks.

In one preferred embodiment, the weak point is provided on the first part, near to the positively locking means which connect the shaft and the first part. In this context, a receiving part is expediently arranged on the first part, the first part having the weak point near to the receiving part. As a result of the receiving part which extends into the first part, the first part is of narrow design in this region and thus advantageously has the weak point.

Further advantages and features of the invention emerge from the following description and from the dependent claims.

The invention is explained in more detail below using preferred exemplary embodiments and with reference to the appended drawings.

BRIEF DESCRIPTION OF THE INVENTION

DETAILED DESCRIPTION OF THE INVENTION

Figure 1:
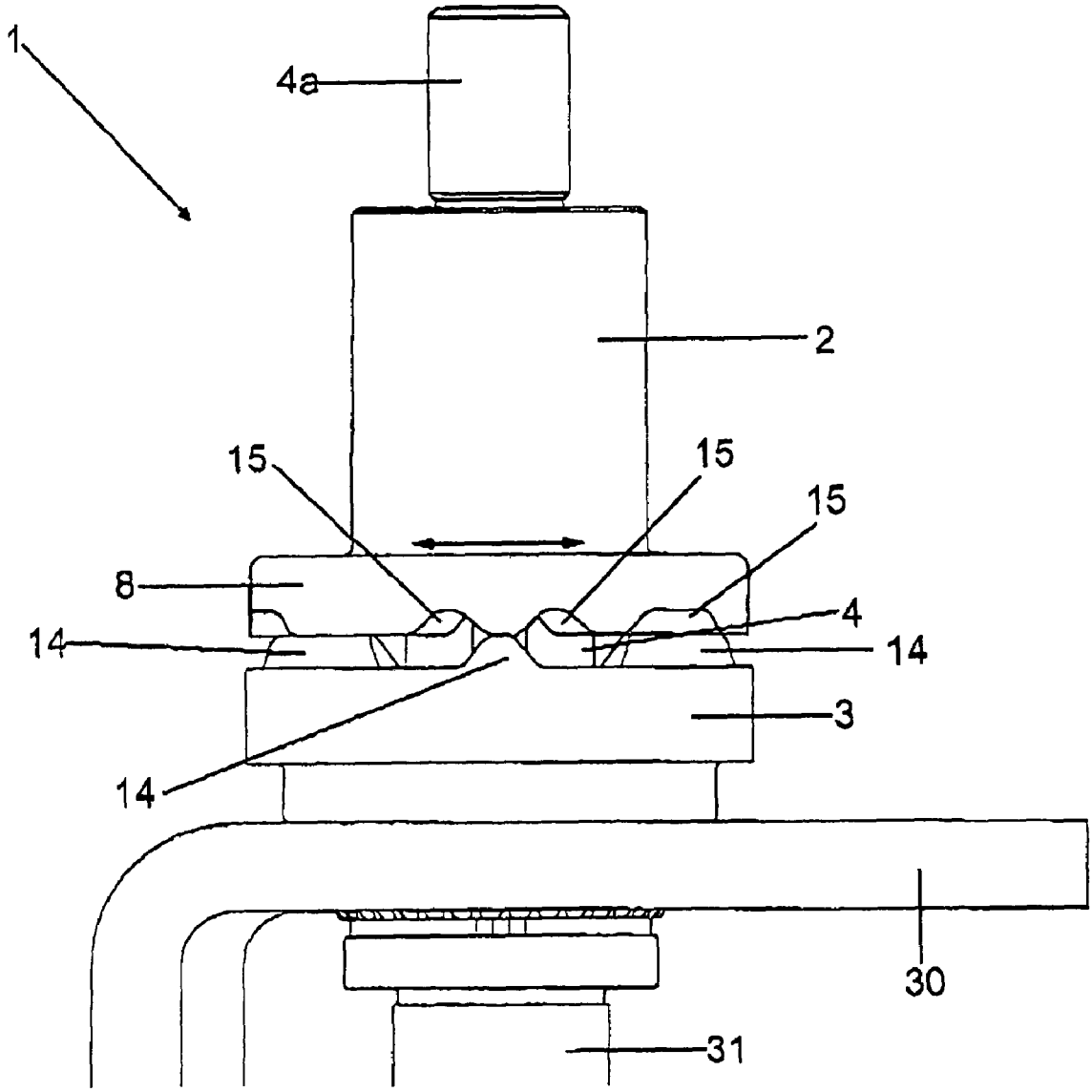
FIG. 1 shows a side view of a first preferred exemplary embodiment of the locking device according to the invention.
Figure 2:
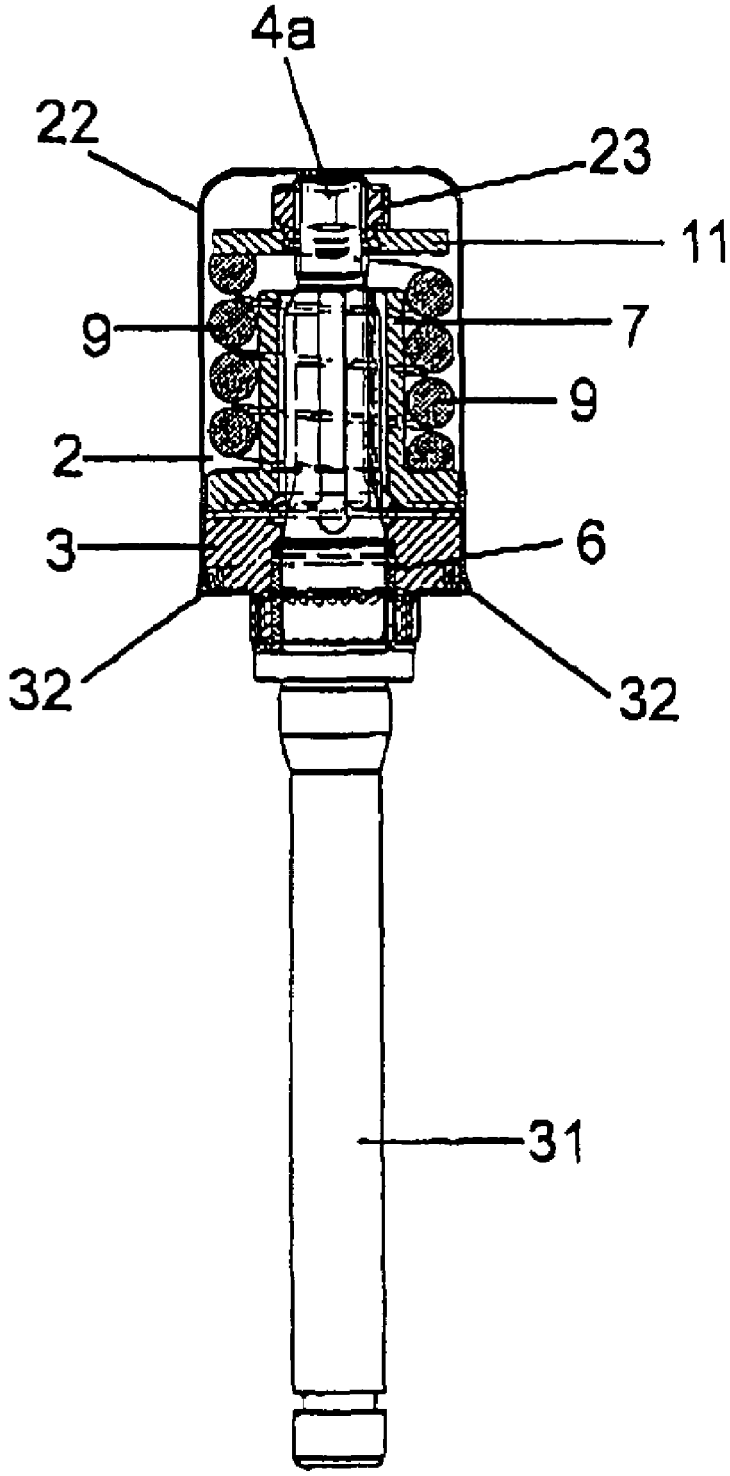
FIG. 2 shows a sectional side view of the exemplary embodiment according to FIG. 1.

FIGS. 1, 2, 3 and 4 show a first preferred exemplary embodiment of a locking device 1 according to the invention for locking a first part 2 to a second part 3.

The first part 2 and the second part 3 are coupled to one another so as to be capable of being pivoted by means of a shaft 4, the first part 2 being connected to the shaft 4 using positively locking means 5, and the second part 3 being mounted on the shaft 4 in a rotatable manner.

The second part 3 is of disk-shaped design, a bore in which the shaft 4 is rotatably mounted by means of a bearing bushing 6 being provided around the center point of the disk. The shaft 4 advantageously extends over the side of the second part 3 facing away from the first part 2, with the result that a hinge pin of a hinge of the door of a motor vehicle can be arranged on the shaft 4*k*, for example.

The second part 3 is arranged on a hinge part of a hinge (not illustrated in more detail), the shaft 4 being coupled to a hinge pin 31 which is mounted in the hinge part 30 with running play.

At the end of the first part 2 facing away from the second part 3, the shaft 4 extends beyond the first part 2 with an end section 4*a*.

The first part 2 has a sleeve section 7 which is arranged around the circumference of the shaft 4. The positively locking means 5 which connect the first part 2 and the shaft 4 comprise two engagement parts 11 which are arranged on the inside of the sleeve section 7, and two receiving parts 12 which are arranged on the shaft 4. The engagement parts 11 are formed as projections which are directed inward from the sleeve section 7 in the direction of the shaft 4. The receiving parts 12 are formed as recesses which are arranged on the shaft 4, in each case an engagement part 11 which is formed as a projection being arranged in a positively locking fashion in a receiving part 12 which is embodied as a recess.

The two engagement parts 11 are arranged diametrically on the inside of the sleeve section 7. The two receiving parts 12 which are assigned to the two engagement parts 11 are correspondingly provided diametrically on the shaft 4.

Each of the two engagement parts 11 has an axial extent along the sleeve section 7, and each of the two receiving parts 12 has an axial extent, matched to the engagement part 11, along the shaft 4 so that the positively locking means 5 connect the shaft 4 and the sleeve section 7 of the first part 2 along the entire axial extent.

It has to be understood that the axial extent of the engagement part 11 and of the receiving part 12 may also be provided partially along the first part 2 or the shaft 4, with the extent of the engagement part 11 and of the receiving part 12 being advantageously adapted to one another.

It also has to be understood that the engagement part 11 and the receiving part 12 may also have any other configuration, with the engagement part 11 being provided, for example, on the inside of the sleeve section 7 of the first part 2 around the circumference in the manner of screws, and the receiving part 12 being correspondingly adapted.

Each of the two engagement parts 11 has an axially constructed canal 13 which extends over the entire engagement part 11. The canal 13 is provided as a reservoir for a lubricant.

Two grooves 16 which are opposite one another and which extend axially in the sleeve section 7 are provided in the sleeve section 7. A damping element 18 is arranged in each of the grooves 16, the damping element 18 having an axial extent which is adapted to the grooves 16. Each of the two damping elements 18 extends radially over the inside of the sleeve section 7 beyond the respective groove 16, each of the two damping elements 18 being arranged with the protruding section in an axial groove 17 which is arranged on the shaft 4.

The damping element 18 has a circular cross section and is formed from a plastic.

Figure 3:
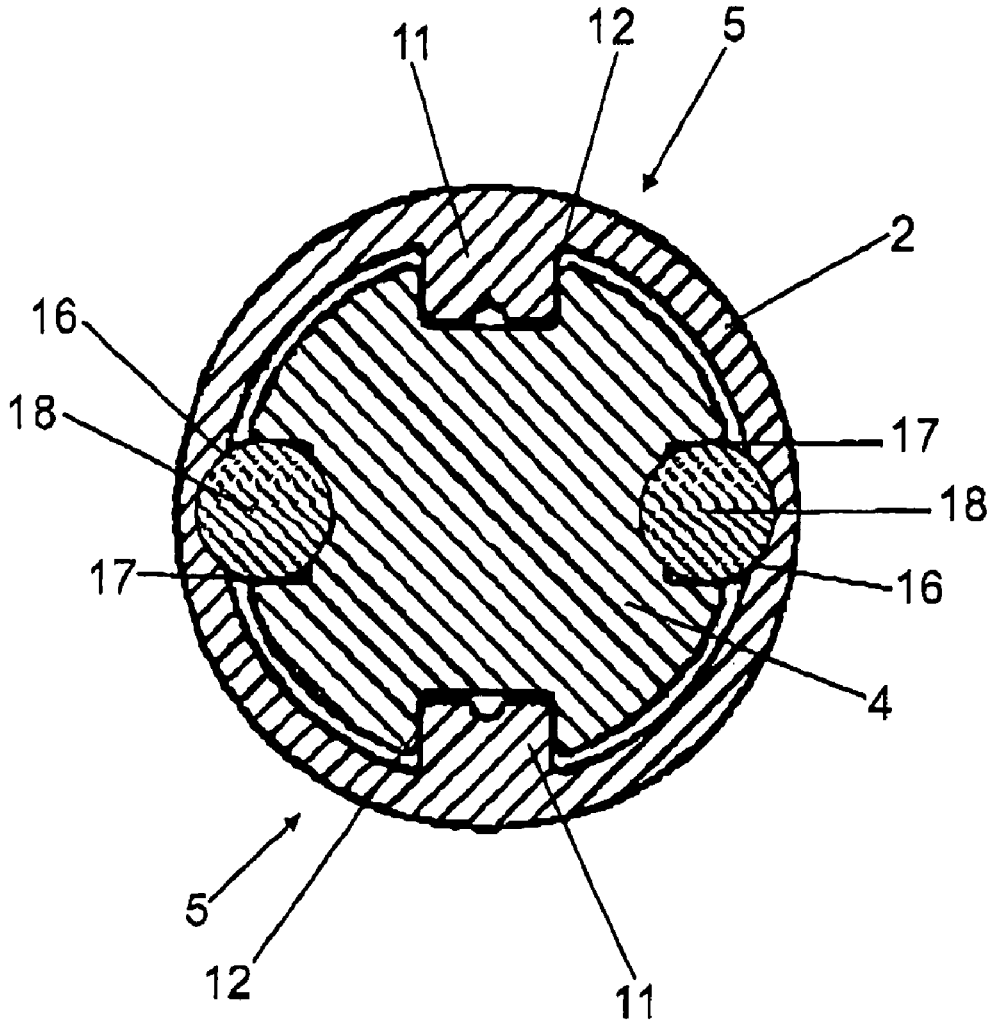
FIG. 3 shows a plan view of the first part, and the shaft according to FIG. 2.
Figure 4:
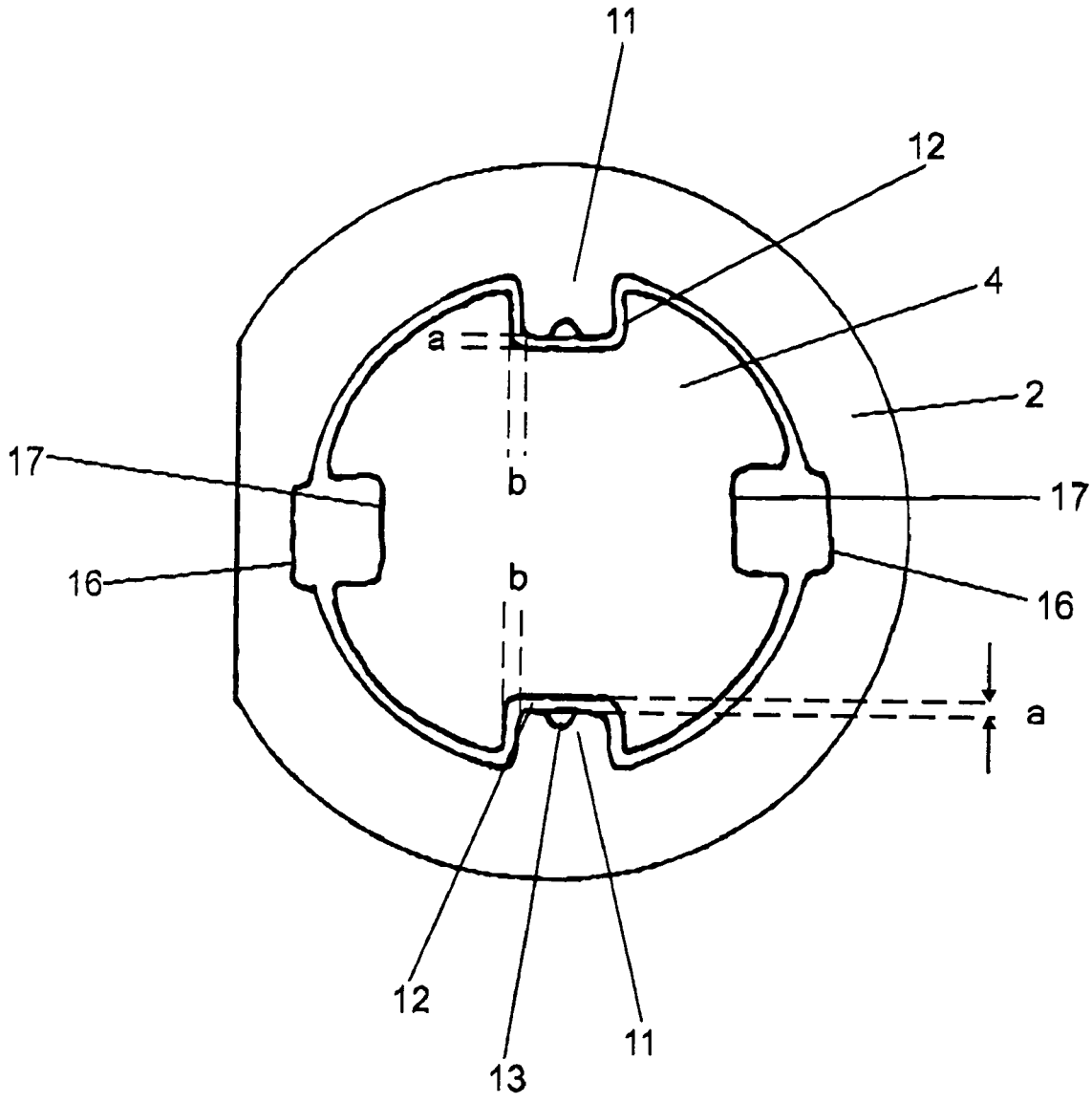
FIG. 4 shows the plan view from FIG. 3 without damping elements.

FIG. 4 shows a plan view corresponding to FIG. 3 with no damping elements 18 arranged in the grooves 16 and 17 of the shaft 4 and of the first part 2 so that on the positively locking means 5 it is possible to see, on the one hand, a first radial play a between the engagement part 11 and the receiving part 12, and a second radial play b between the first part 2 and the shaft 4. The first radial play a is formed between an end side 11*a* of the engagement part 11 and an end side 12*a* of the receiving part 12. The second radial play b is formed in each case between the two side faces 11*b* of the engagement part 11 and the side faces 12*b* of the receiving part 12. The radial play a has a larger extent than the radial play b.

By inserting the damping elements 18 into the grooves 16 and 17, wherein in each case two grooves 16 being arranged on the first part 2 and two grooves 17 being arranged diametrically opposite on the shaft 4, the first radial play a and the second radial play b are compensated.

A disk-shaped collar 8 is provided at the end of the sleeve section 7 of the first part 2, facing the second part 3, and the disk-shaped collar 8 is arranged on an outside of the sleeve section 7 and extends radially outward from the shaft 4.

The disk-shaped collar 8 can be engaged with the second part 3 which is formed in the shape of a disk, the collar 8 and the second part 3 having the same radius so that the second part 3 and the collar 8 have the same radial extent.

On a face being turned toward the first part 2 of the second part 3 which is constructed in the form of a disk, three securing elements 14 which are embodied as cams are provided, the three securing elements 14 each being arranged at an angle of 120° with respect to one another so that the three latching elements 15 are distributed uniformly over the disk-shaped second part 3. The cams extend over the second part 3 in the direction of the first part 2 and have an arcuate design, the wide extent of the arc being arranged on the second part 3 and the dome of the arc curving over the second part 3 in the direction of the first part 2.

The securing elements 14 which are embodied as cams extend transversely with respect to the radius of the second part 3 so that a first end of the cam is oriented in the direction of the bore which is formed at the center point of the second part 3, and a second end is oriented in the direction of the edge of the second part 3, with the second end of the cam finishing approximately flush with the edge of the second part 3.

On the face, turned toward the second part 3, of the collar 8 of the first part 2 three latching elements 15 which are embodied as recesses are provided, the three latching elements 15 each being arranged at an angle of approximately 20° with respect to one another. Two of the latching elements 15 which are embodied as a recess have an arcuate cross section which is adapted to the arcuate configuration of the securing elements 14, with the wide extent of the arc being provided on the edge of the collar 8, and the dome of the arc curving into the collar 8. The third of the latching elements 15 has a recess which is widened along the face of the collar 8 facing the second part 3, this widened portion being assigned to the region of the pivot angle in which the first part 2 can be pivoted with respect to the second part 3 without the application of a force, said pivoting being, for example, an angular range for closing the door of a motor vehicle so that the third latching element 15 forms an aid for pulling the door of the motor vehicle closed.

The latching elements 15 provided in the collar 8 form in each case a recess into which the cams of the securing elements 14 engage in order to lock the first part 2 to the second part 3.

It has to be understood that the securing elements 14 and the latching elements 15 can have any other configuration such as, for example, being configured in each case as a wave profile, the wave profile which is arranged on the collar 8 engaging in, for the purpose of locking, the wave profile which is arranged on the second part 3.

A screw-like compression spring 9 is arranged around the sleeve section 7 of the first part 2 and is supported at one end against the side of the collar 8 facing away from the second part 3 and at the other end against a thrust washer 10 which is arranged on the end section 4*a* of the shaft 4, with the thrust washer 10 forming a counterbearing for the compression spring 9. The thrust washer 10 is securely connected to the end section 4*a* of the shaft 4, with the end section 4*a* having, for example in the region of the thrust washer 10, a circumferential knurling to which the thrust washer 10 is secured.

The end section 4*a* extends beyond the thrust washer 10, with a screw 22 being arranged on the end section 4*a* in order to secure the thrust washer 10 axially to the shaft 4 so that the counterbearing for the compression spring 9 is formed by the thrust washer 10.

The first part 2 is prestressed with a force in the direction of the second part 3 by the spring force of the compression spring 9, as a result of which the securing elements 14 which are formed as cams are held in the latching elements 15 which are formed as recesses.

A cylindrical cap 22 which surrounds the first part 2, the compression spring 9 and the thrust washer 10 is arranged on the second part 3, the cap 22 being securely connected to the second part 3 by means of a bead, and the first part 2 and the compression spring 9 and the thrust washer 10 being pivotable with respect to the cap 22.

The locking device functions as follows:

As a result of the rotational movement of the shaft 4, a force corresponding to the rotational movement is exerted on the first part 2, the securing elements 14 which engage in the latching elements 15 firstly preventing the first part 2 from rotating with respect to the second part 3. Correspondingly, the first part 2 is subject to a small degree of twisting, with the collar 8 of the first part 2 experiencing a rotational force, while that end of the first part 2 which lies opposite the collar 8 is not subject to a force effect at first. When the applied force exceeds the securing force acting on the first part 2 as a result of the compression spring 9, the first part 2 is pushed along the securing elements 14 which are of arcuate design and are arranged on the second part 3, with the first part 2 being pushed axially along the shaft 4 away from the second part 3 counter to the spring force of the compression spring 9 owing to the securing elements 14 which are configured in an arcuate shape and the latching elements 15 which are of correspondingly arcuate design.

When the first part 2 reaches the region of the dome of the arcuate securing elements 14 with the latching elements 15 during the axial movement and twisting, the force which is transmitted to the first part 2 by the twisting is released so that as a result without damping elements the first part 2 tilts and strikes against the shaft 4. As a result of the damping elements 18 according to the invention, this tilting and striking is however avoided, while the force which is released is compensated by the damping elements 18.

As a result of the relative rotational movement of the first part 2 with respect to the second part 3, the collar 8, provided with the securing elements 14, of the first part 2 is rotated with respect to the disk-shaped second part 3 which is provided with the latching elements 15, while the securing elements 14 are moved relative to the latching elements 15. In a securing position which is predefined by the securing elements 14 and latching elements 15, the securing elements 14 engage with the latching elements 15, the projections of the securing elements 14 moving into the recesses in the latching elements 15 and being held in them by the compression spring 9 with a securing force so that the first part 2 is locked to the second part 3.

Figure 5:
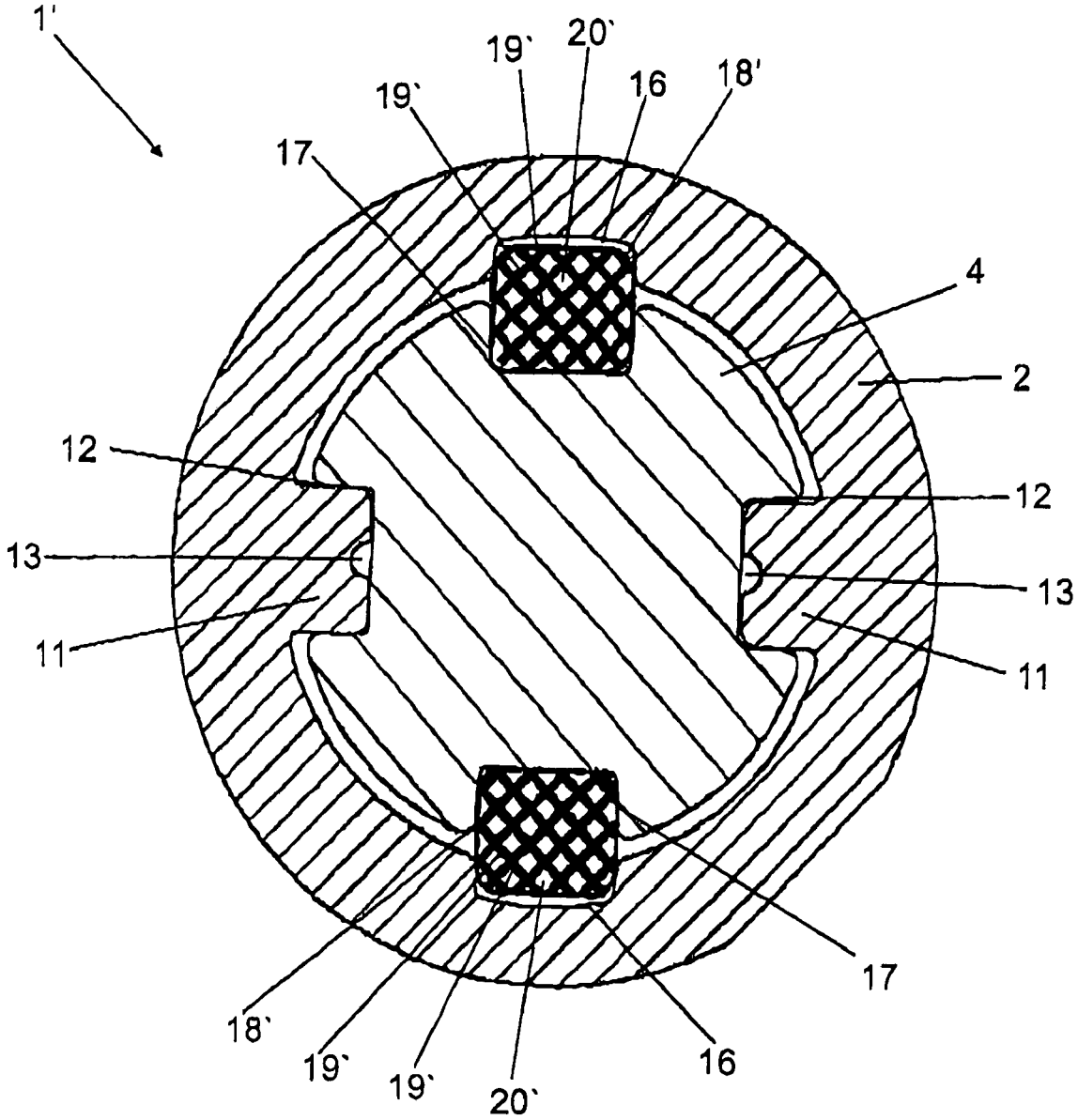
FIG. 5 shows a plan view of the first part and the shaft of a second exemplary embodiment.

FIG. 5 shows a second exemplary embodiment of a locking device 1' according to the invention with the same reference symbols being assigned to identical or functionally identical components. The text which follows deals essentially with the differences with respect to the first exemplary embodiment.

The two damping elements 18' which are assigned to the first part 2 and to the shaft 4 have a rectangular cross section. The two damping elements 18' are formed from a plurality of plastic layers 19', the plastic layers 19' being arranged in a cross shape with respect to one another at an angle of approximately 90°, as a result of which square intermediate spaces 20' are formed which further increase the elasticity of the damping element 18'.

The method of operation of the locking device 1' according to the second exemplary embodiment is identical to that of the first exemplary embodiment.

Figure 6:
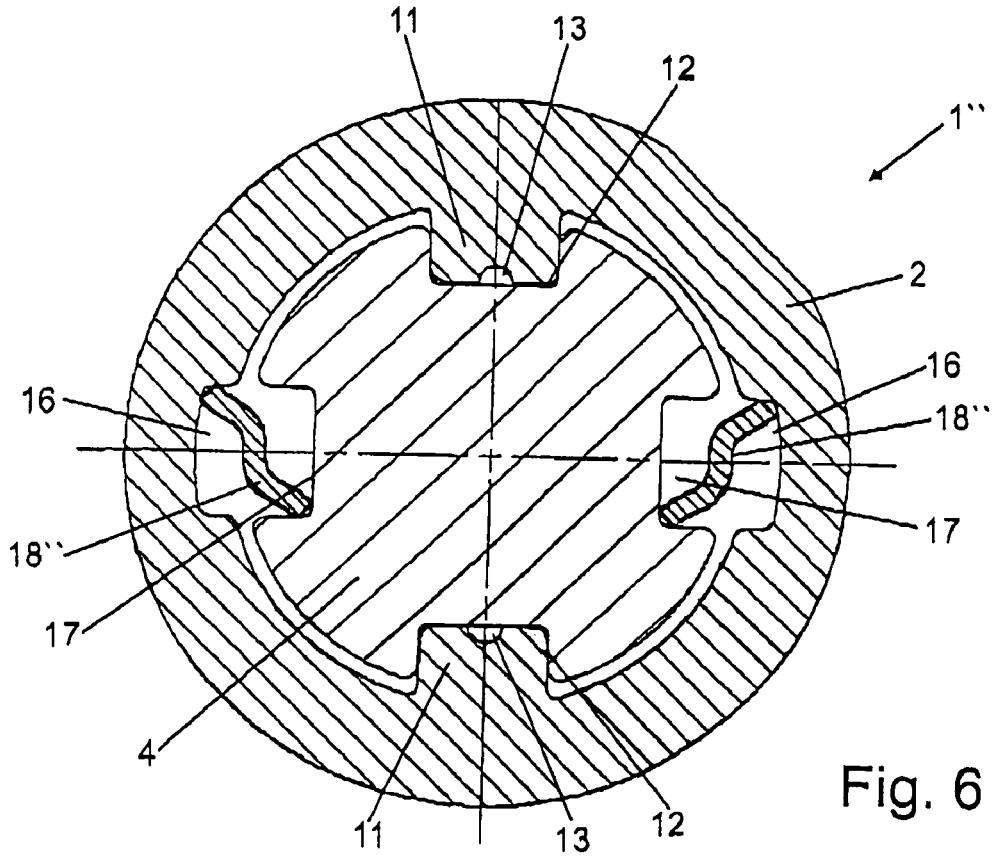
FIG. 6 shows a plan view of the first part and the shaft of a third exemplary embodiment.

FIG. 6 shows a third exemplary embodiment of a locking device 1" according to the invention with the same reference symbols being assigned to identical or functionally identical components. The text which follows deals essentially with the differences with respect to the first exemplary embodiment.

The two damping elements 18" which are assigned to the first part 2 and to the shaft 4 are formed from a metal and have a cross section which is embodied approximately in the shape of an S, a first end of the S being arranged in the axial groove 16 arranged on the first part 2, and a second end of the S being arranged in the axial groove 17 which is arranged on the shaft 4.

As a result of the S-shaped configuration of the metallic damping elements 18", said elements are of resilient design and are supported at the one end in the groove 16 of the first part 2 and at the other end in the groove 17 of the shaft 4 so that adaptation is carried out by the two damping elements 18" in order to compensate the first radial play a and the second radial play b between the first part 2 and the shaft 4.

The method of operation of the locking device 1" according to the third exemplary embodiment is identical to that of the first exemplary embodiment.

Figure 7:
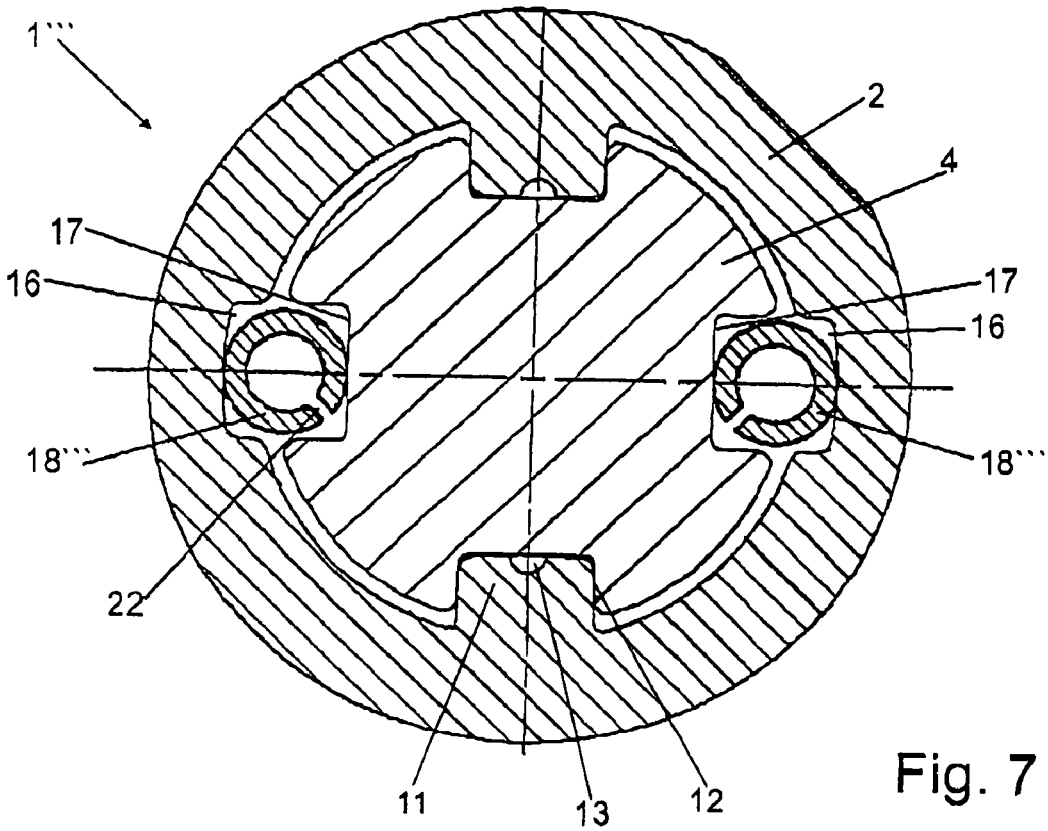
FIG. 7 shows a plan view of the first part and the shaft of a fourth exemplary embodiment.

A fourth exemplary embodiment of a locking device 1''' according to the invention is shown in FIG. 7, with the same reference symbols being assigned to identical or functionally identical components. The text which follows deals essentially with the differences with respect to the first exemplary embodiment.

The two damping elements 18''' which are assigned to the first part 2 and to the shaft 4 are formed from a metal and have a cross section which is formed approximately in the shape of a C and has a distance 22, the damping element 18''' being arranged in the groove 16 of the first part 2 and in the groove 17 of the shaft 4 with the back of the C so that the damping elements 18''' are supported in a resilient fashion on the first part 2 and the shaft 4.

As a result of the C-shaped configuration of the metallic damping elements 18''' they are of resilient design so that adaptation can be brought about by means of the two damping elements 18''' in order to compensate the first radial play a and the second play b between the first part 2 and the shaft 4. The degree of resilience is determined, on the one hand, by the material and, on the other hand, by the size of the distance 22 in the C shape.

The method of operation of the locking device 1''' according to the fourth exemplary embodiment is identical to that of the first exemplary embodiment.

Figure 8:
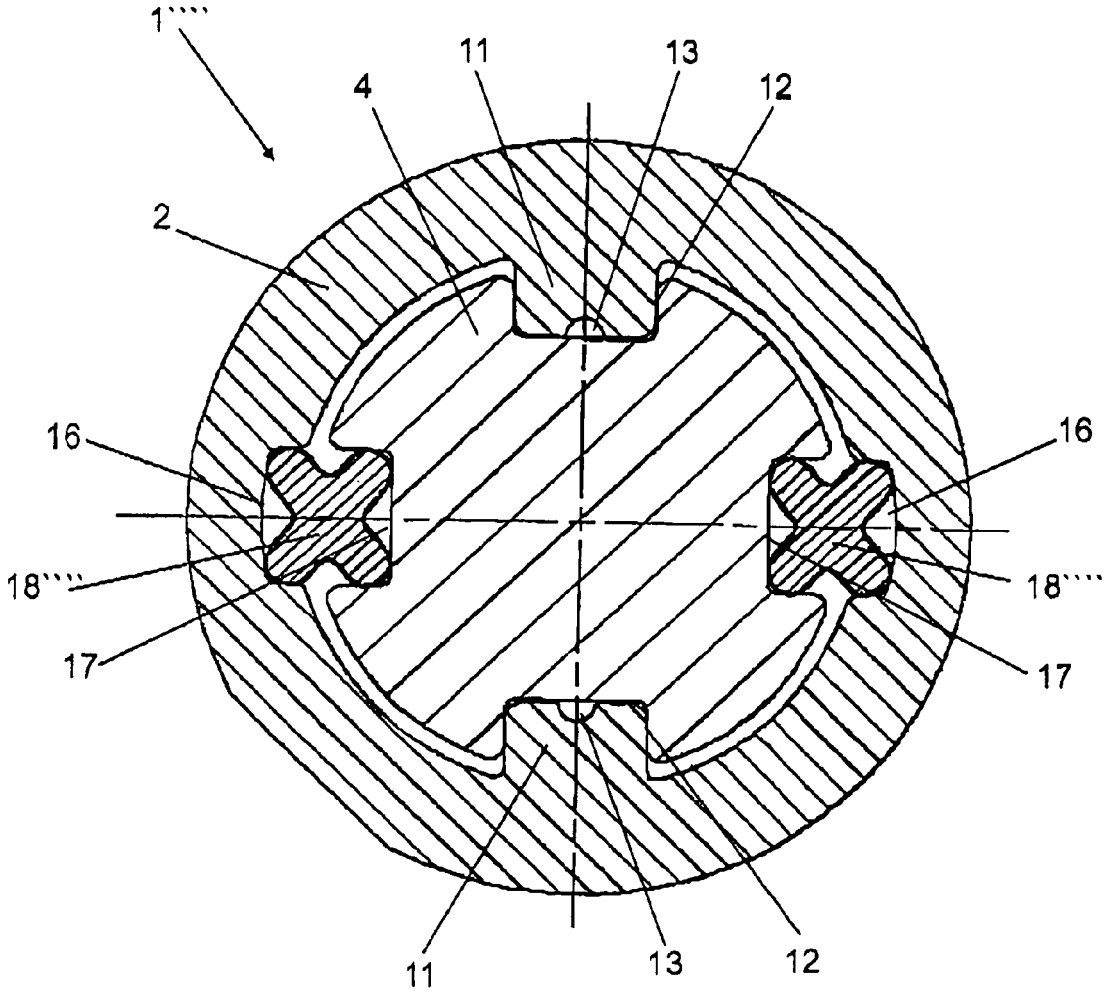
FIG. 8 shows a plan view of the first part and the shaft of a fifth exemplary embodiment.

A fifth exemplary embodiment of a locking device 1'''' according to the invention is shown in FIG. 8, the same reference symbols being assigned to identical or functionally identical components. The text which follows deals essentially with the differences with respect to the first exemplary embodiment.

The two damping elements 18'''' which are assigned to the first part 2 and to the shaft 4 have an X-shaped cross section and are constructed from a plastic. As a result of the X-shaped configuration of the damping elements 18'''', the elasticity of the two damping elements 18'''' which is provided by means of the plastic is increased so that the two damping elements 18'''' between the first part 2 and the shaft 4 are adapted in order to compensate the first radial play a and the second play b.

The method of operation of the locking device 1'''' according to the fifth exemplary embodiment is identical to that of the first exemplary embodiment.

Figure 9:
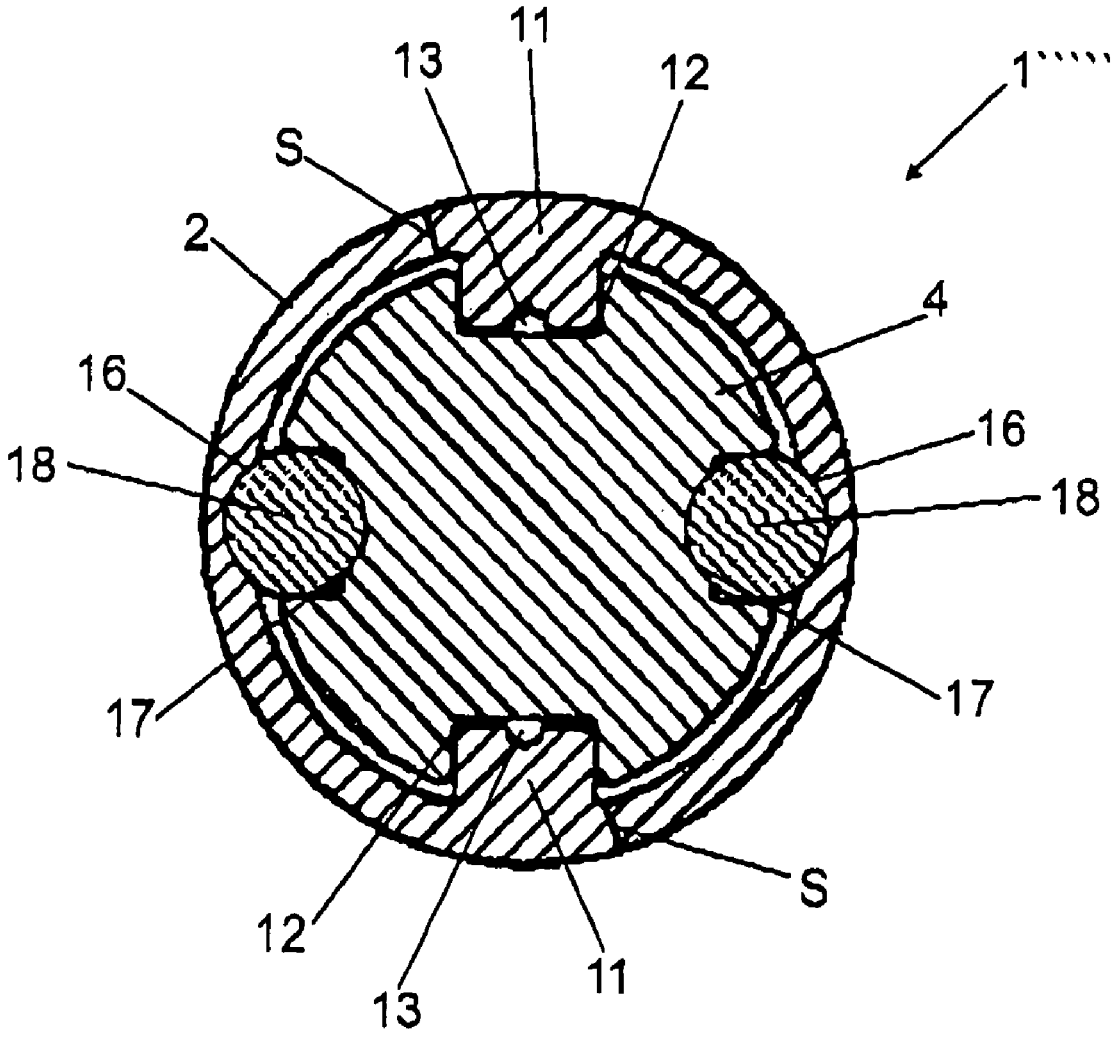
FIG. 9 shows a plan view of the first part and the shaft of a sixth exemplary embodiment.

FIG. 9 shows a sixth exemplary embodiment of a locking device 1''''' according to the invention, the same reference symbols being assigned to identical or functionally identical components. The text which follows deals essentially with the differences with respect to the first exemplary embodiment.

The first part 2 has in each case a weak point S in the region between the two positively locking means 5, with the two weak points S being provided diametrically opposite one another. When force is applied to the locking device 1''''', the shaft 4 is rotated and the two receiving parts 12 exert a corresponding force on the two engagement parts 11 and thus on the first part 2. As a result of the rotational movement of the shaft 4, the loading weak points of the first part 2 are each arranged on opposite sides of the pair formed from the engagement part and receiving part. If the application of force as a result of the rotation of the shaft 4 becomes too large, the first part 2 breaks at the two weak points S and the shaft 4 is released.

What is claimed is:

1. A locking device for locking a hinge part to a hinge pin, wherein the hinge part is pivotable with respect to the hinge pin, the locking device comprising:

a first part, a second part, and a shaft which connects the first part and the second part to one another in a pivotable manner, wherein the second part is coupled to, or is constructed integrally with, the hinge part, wherein the shaft is coupled to, or is constructed integrally with, the hinge pin, wherein a rotational movement of the shaft entrains the first part in rotation, wherein the second part is rotatably mounted on the shaft, wherein the first part is arranged on the shaft in an axially moveable fashion, wherein one of the first part and the second part comprises a protruding element which can be positively engaged with a latching element of the other of the first part and the second part for locking the first part to the second part so that the first part cannot rotate with respect to the second part, and wherein at least one damping element is disposed between the first part and the shaft for damping of a relative movement between the first part and the shaft.

2. The locking device as claimed in claim 1, wherein at least two damping elements are provided.

3. The locking device as claimed in claim 1, wherein the first part comprises a sleeve section.

4. The locking device as claimed in claim 1, wherein the first part has a groove, wherein the at least one damping element is arranged at least partially in the groove.

5. The locking device as claimed in claim 1, wherein the shaft has a groove, wherein the at least one damping element is arranged at least partially in the groove.

6. The locking device as claimed in claim 1, wherein the first part and the shaft are connected to one another having positive fit.

7. The locking device as claimed in claim 6, further comprising at least one engagement part which is arranged on either the shaft or the first part, and at least one receiving part which is arranged on the other of the shaft and the first part, the at least one engagement part and the at least one receiving part being positively engaged.

8. The locking device as claimed in claim 7, wherein two engagement parts and two receiving parts are provided.

9. The locking device as claimed in claim 6, wherein a canal is provided on one of the at least one engagement part and the at least one receiving part.

10. The locking device as claimed in claim 9, wherein the canal has a semicircular cross section.

11. The locking device as claimed in claim 1, wherein the damping element is of elastic design.

12. The locking device as claimed in claim 1, wherein the at least one damping element is constructed from a plastic.

13. The locking device as claimed in claim 1, wherein the damping element is constructed from polyetheretherketone.

14. The locking device as claimed in claim 1, wherein the at least one damping element has a circular cross section.

15. The locking device as claimed in claim 1, wherein the at least one damping element has a rectangular cross section.

16. The locking device as claimed in claim 1, wherein the at least one damping element has a C-shaped cross section.

17. The locking device as claimed in claim 1, wherein the at least one damping element has an S-shaped cross section.

18. The locking device as claimed in claim 1, wherein the at least one damping element has an X-shaped cross section.

19. The locking device as claimed in claim 1, wherein the at least one damping element has at least one obliquely tapering end.

20. The locking device as claimed in claim 1, wherein the at least one damping element has contouring.

21. The locking device as claimed in claim 1, wherein a spring element acts on the first part in the direction of the second part.

22. The locking device as claimed in claim 21, wherein the spring element is supported on a thrust washer which is connected to the shaft.

23. The locking device as claimed in claim 21, wherein the spring element is supported against a collar which is provided on the first part.

24. The locking device as claimed in claim 1, wherein the second part is embodied as a disk.

25. The locking device as claimed in claim 1, wherein the first part and the second part are surrounded by a cap.

26. The locking device as claimed in claim 1, wherein at least one protruding element is arranged on either the first part or the second part.

27. The locking device as claimed in claim 26, wherein at least one latching element, in which the at least one protruding element engages, is provided on the other of the first part and the second part.

28. The locking device as claimed in claim 27, wherein the at least one protruding element comprises a cam, and wherein the at least one latching element comprises a latching recess.

29. The locking device as claimed in claim 27, wherein either the at least one protruding element or the at least one latching element is arranged on a collar of the first part.

30. The locking device as claimed in claim 29, wherein the collar is of disk shaped design.

31. The locking device as claimed in claim 29, wherein at least three securing elements are provided on the collar, said securing elements each being at an angle of approximately 120° with respect to one another, and wherein three corresponding latching elements are provided on the second part.

32. The locking device as claimed in claim 1, wherein the first part has a weak point which breaks when overloading occurs and releases the shaft.

33. The locking device as claimed in claim 32, wherein the first part has at least two weak points which are oriented diametrically with respect to one another.

34. The locking device as claimed in claim 32, wherein the first part has a sleeve section.

35. The locking device as claimed in claim 34, wherein the sleeve section has the weak point.

36. The locking device as claimed in claim 32, wherein the first part and the shaft are connected to one another having positive fit.

37. The locking device as claimed in claim 36, further comprising at least one engagement part which is arranged on either the shaft or the first part, and at least one receiving part which is arranged on the other of the shaft and the first part, the at least one engagement part and the at least one receiving part being positively engaged.

38. The locking device as claimed in claim 37, wherein the weak point is provided near to either the engagement part or the receiving part on the first part.

39. The locking device as claimed in claim 1, wherein the shaft is embodied as an extension of a hinge pin.

40. A hinge for a motor vehicle, the hinge comprising a hinge pin, a hinge part being pivotable with respect to the hinge pin, and a locking device for locking the hinge part to the hinge pin, wherein the locking device comprises a first part and a second part, wherein the first part is received in an axially displaceable manner on a section of the hinge pin, said section of the hinge pin defining a shaft, wherein the second part is coupled to, or is constructed integrally with, the hinge part, such that a rotational movement of the hinge part with respect to the hinge pin entrains the second part in rotation with respect to the first part, wherein one of the first part and the second part comprises a protruding element which can be positively engaged with a latching element of the other of the first part and the second part for locking the first part to the second part so that the first part cannot rotate with respect to the second part, and wherein at least one damping element is disposed between the first part and the shaft for damping a relative movement between the first part and the shaft.

41. A locking device for locking a hinge part to a hinge pin, the locking device comprising a shaft, a first part being received in an axially displaceable manner on the shaft, a second part being rotatably mounted on the shaft, and a spring element, wherein the second part is coupled to, or is constructed integrally with, the hinge part, such that a rotational movement of the hinge part with respect to the hinge pin entrains the second part in rotation with respect to the shaft, wherein one of the first part and the second part comprises a protruding element which can be positively engaged with a latching element of the other of the first part and the second part, wherein the spring element loads the first part with respect to the shaft in a direction towards the second part for locking the first part to the second part so that the first part cannot rotate with respect to the second part, and wherein at least one damping element is disposed between the first part and the shaft for damping a relative movement between the first part and the shaft.

* * * * *